US008074401B2

(12) United States Patent
Brown

(10) Patent No.: US 8,074,401 B2
(45) Date of Patent: Dec. 13, 2011

(54) MECHANICAL ARM SYSTEM FOR OPENING A DOOR

(75) Inventor: Booker T. Brown, Melrose, MA (US)

(73) Assignee: The MITRE Corporation, McLean, VA (US)

( * ) Notice: Subject to any disclaimer, the term of this patent is extended or adjusted under 35 U.S.C. 154(b) by 952 days.

(21) Appl. No.: 11/770,686

(22) Filed: Jun. 28, 2007

(65) Prior Publication Data

US 2009/0000198 A1 Jan. 1, 2009

(51) Int. Cl.
*E05F 11/24* (2006.01)

(52) U.S. Cl. ..... 49/346; 49/339; 49/341; 49/344

(58) Field of Classification Search ..... 49/339, 49/340, 341, 342, 344, 346
See application file for complete search history.

(56) References Cited

U.S. PATENT DOCUMENTS

| | | | | | |
|---|---|---|---|---|---|
| 714,669 | A * | 12/1902 | Champion | 49/339 |
| 2,946,081 | A * | 7/1960 | Juergens | 16/80 |
| 2,959,806 | A * | 11/1960 | Stewart | 16/80 |
| 3,510,986 | A * | 5/1970 | Berkowitz | 49/386 |
| 4,222,147 | A * | 9/1980 | Burnett, Jr. | 16/62 |
| 4,365,442 | A * | 12/1982 | Speer | 49/346 |
| 4,660,324 | A * | 4/1987 | Nyenbrink | 49/340 |
| 5,881,497 | A | 3/1999 | Borgardt | |
| 5,910,075 | A * | 6/1999 | Arnell et al. | 49/25 |
| 6,002,217 | A | 12/1999 | Stevens et al. | |
| 6,634,140 | B1 | 10/2003 | Sellman | |
| 6,889,501 | B2 * | 5/2005 | Busch | 60/473 |
| 6,891,479 | B1 | 5/2005 | Eccleston | |
| 7,068,179 | B2 | 6/2006 | Snell et al. | |
| 7,373,756 | B2 * | 5/2008 | Okulov et al. | 49/346 |
| 7,624,555 | B2 * | 12/2009 | Paquin | 52/783.1 |
| 7,707,774 | B2 * | 5/2010 | Molnar et al. | 49/340 |
| 2005/0091928 | A1 * | 5/2005 | Okulov et al. | 49/341 |
| 2006/0042165 | A1 * | 3/2006 | Baczewski et al. | 49/334 |
| 2009/0165387 | A1 * | 7/2009 | Goldstein et al. | 49/340 |

* cited by examiner

*Primary Examiner* — Katherine Mitchell
*Assistant Examiner* — Catherine A Kelly
(74) *Attorney, Agent, or Firm* — Sterne Kessler Goldstein & Fox P.L.L.C.

(57) ABSTRACT

A mechanical arm system for opening a door includes an actuator assembly having an output shaft and an arm driven by the output shaft so as to move the door from a closed position toward an open position. The arm is free from contact with the door when the door moves from the open position to the closed position. The actuator assembly is mounted to a support member adjacent the door. The arm extends between the output shaft and the door. The arm may be moveable between a position in which the arm contacts the door in the open position and a retracted position in which the arm is free from contact with the door in the closed position. The arm may be moved to the retracted position before the door reaches the open position so as to abort the opening of the door.

16 Claims, 10 Drawing Sheets

MECHANICAL ARM SYSTEM FOR OPENING A DOOR

BACKGROUND OF THE INVENTION

1. Field of the Invention

The present invention relates to automatic door openers and other systems for opening or closing a door. More particularly, the present invention relates to a mechanical arm system for opening a door, especially a Sensitive Compartmented Information Facility (SCIF) door, in which no component of the mechanical arm system is mounted on, or makes permanent contact with, the door.

2. Background Art

Automatic door openers, for many different applications, are well known in the art. Automatic door openers may be equipped on doors of public facilities to allow passage through the doorway of people without their manual operation. Automatic door openers may incorporate hydraulic, pneumatic, and electromechanical devices. For example, a conventional automatic door opener for opening or closing a door includes an a control unit, an actuator driving a drive shaft and an articulated opener arm extending between the drive shaft and the door. An end of the opener arm is either permanently mounted on one of the door or the door frame, with the actuator and drive shaft combination mounted on the other of the door frame or the door. The opener arm responds to movement of the drive shaft to extend or contract so as to move the door to an open or closed position, respectively. The control unit may include adjustable timers and sensors to control the movement of the door, and to identify when an obstacle is encountered in the door's pathway. Typically, the door opener must complete its opening process of placing the door in the open position before closure of the door can be initiated.

Consequently, such a conventional door opener is unacceptable for use with a SCIF door. The requirements for an SCIF door are dictated by the U.S. government, and two of these requirements provide that, except for the lock, key bypass, a door closer, and crash-put bar, nothing additional can be installed which makes permanent contact with the door and that the door must be able to return to its closed state, quickly, at any point in its forward opening cycle.

What is needed, therefore, is a mechanism for automatically opening a door, in which none of the mechanism's components are mounted on the door itself, and further allows for closure of the door from any position during the door opening process. The present invention satisfies these and other needs, as will be made apparent by the description of the present invention that follows.

BRIEF SUMMARY OF THE INVENTION

A mechanical arm system for opening a door is presented. In one embodiment, the system includes an actuator assembly having an output shaft and an arm driven by the output shaft for moving the door from a closed position to an open position. The actuator assembly is mounted to a support member adjacent the door, and the arm selectively contacts the door to move the door toward the open position. The arm is moveable between a position in which the arm contacts the door in the open position and a retracted position in which the arm is free from contact with the door in the closed position. The door may be manually opened as well. The actuator assembly may be supported on a wall above the door.

In one embodiment, the arm pivots in a first direction for contacting the door and a second direction for retracting from contact with the door, the arm pivoting with rotation of the output shaft. The actuator assembly may include a hydraulic rack and pinion rotary actuator having a piston that drives a rack which meshes with a pinion, and the output shaft is coaxial with the pinion and rotates with rotation of the pinion. The mechanical arm system may include a controller unit, which activates and deactivates the hydraulic actuator and controls a rotational direction of the output shaft so as to pivot the arm in the first direction or the second direction. The system may further include a hydraulic pump for supplying fluid to the hydraulic actuator, and the controller unit controls start and stop of the hydraulic pump so as activate and deactivate the hydraulic actuator, and controls the direction of fluid displacement by the pump so as to control the rotational direction of the output shaft. An open switch may be included for initiating movement of the door toward the open position under force of the arm. When the open switch has been activated, the controller unit controls the rotational direction of the output shaft so as to pivot the arm in the first direction, whereby the arm contacts the door and moves the door toward the open position. A stop switch may be included for aborting movement of the door toward the open position under force of the arm. A pressure overload sensor may be included for sensing when the hydraulic pressure of fluid supplied to the hydraulic actuator rises above a pre-set limit. When the pre-set pressure limit has been exceeded, the controller unit controls the rotational direction of the output shaft so as to so as to move the arm to the retracted position.

The system may further include a relay sensor that senses when the door has reached the open position under force of the arm, wherein when the open position has been sensed, the controller unit deactivates the hydraulic actuator, the arm remaining in contact with the door and holding the door in the open position until the arm has been moved to the retracted position. In one embodiment, a timer in electronic communication with the controller unit determines the amount of time the door is held in the open position by the arm, and when a predetermined amount of time has passed, the controller unit activates the actuator and controls the rotational direction of the output shaft so as to move the arm to the retracted position In another embodiment of the mechanical arm system, the arm extends between the output shaft and the door, and the arm contacts the door only when the door is being moved from a closed position toward an open position and when the arm temporarily holds the door in the open position. The controller unit controls the actuator assembly so as to alternatively rotate the output shaft in a first direction and a second direction opposite the first direction. When the controller unit activates the actuator assembly to initiate a door opening process, the output shaft is rotated in a first direction to move the arm against the door so as to force the door toward the open position. The system may include a stop switch. The opening process is aborted when the stop switch is activated, with the controller unit activating the actuator assembly so that the output shaft rotates in the second direction and moves the arm away from contact with the door. The door is then free to close under its own power.

Further embodiments, features, and advantages of the present inventions, as well as the structure and operation of the various embodiments of the present invention, are described in detail below with reference to the accompanying drawings.

BRIEF DESCRIPTION OF THE DRAWINGS/FIGURES

The accompanying drawings, which are incorporated herein and form part of the specification, illustrate the present invention and, together with the description, further serve to explain the principles of the invention and to enable a person skilled in the relevant art(s) to make and use the invention. In the drawings, like reference numbers, letters, or renderings indicate identical or functionally similar elements.

DETAILED DESCRIPTION OF THE INVENTION

Figure 1:
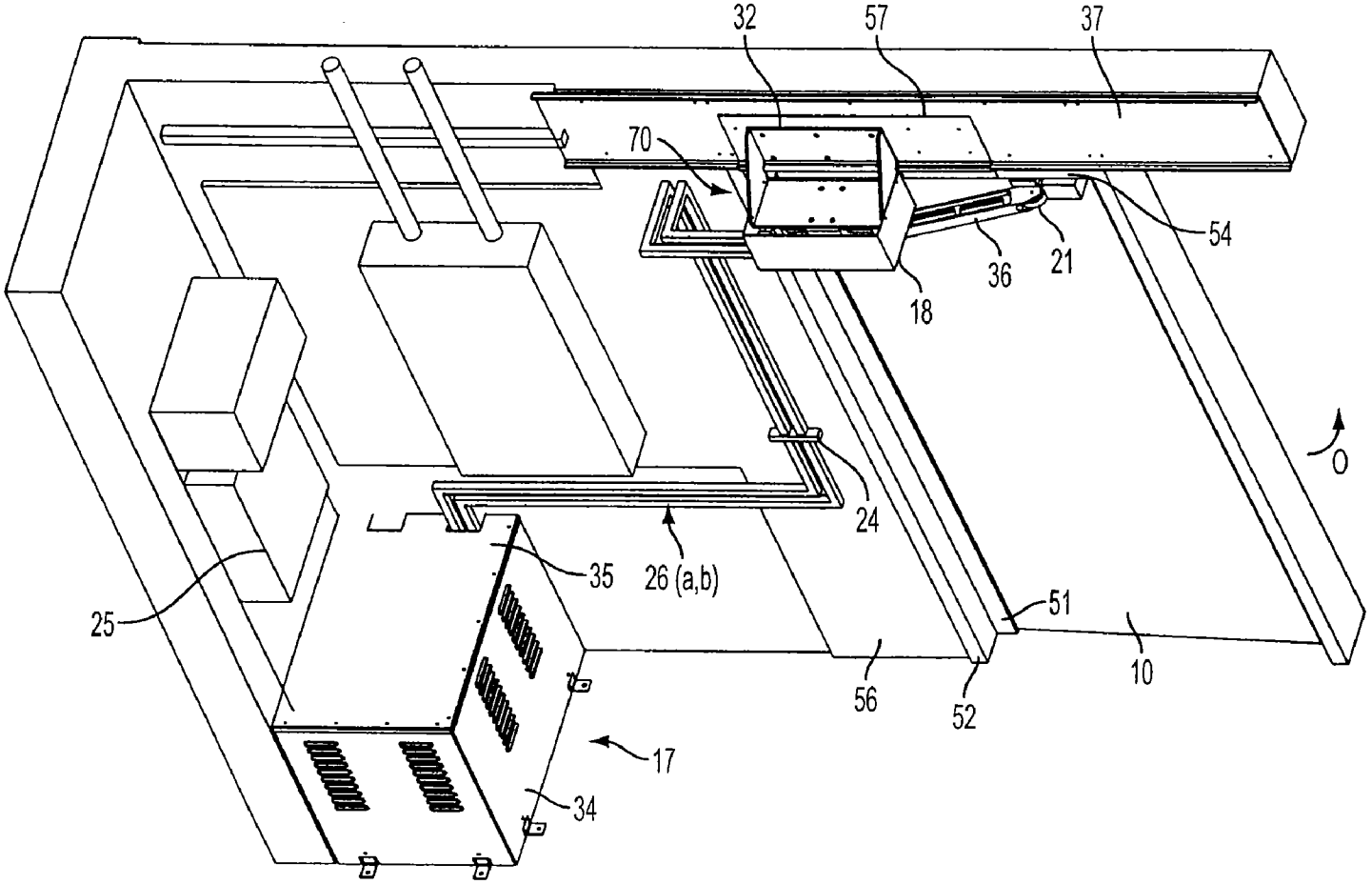
FIG. 1 is a perspective top view, partially broken away, of a mechanical arm system disposed in an exemplary environment of a door's interior side, in accordance with an embodiment presented herein.
Figure 2:
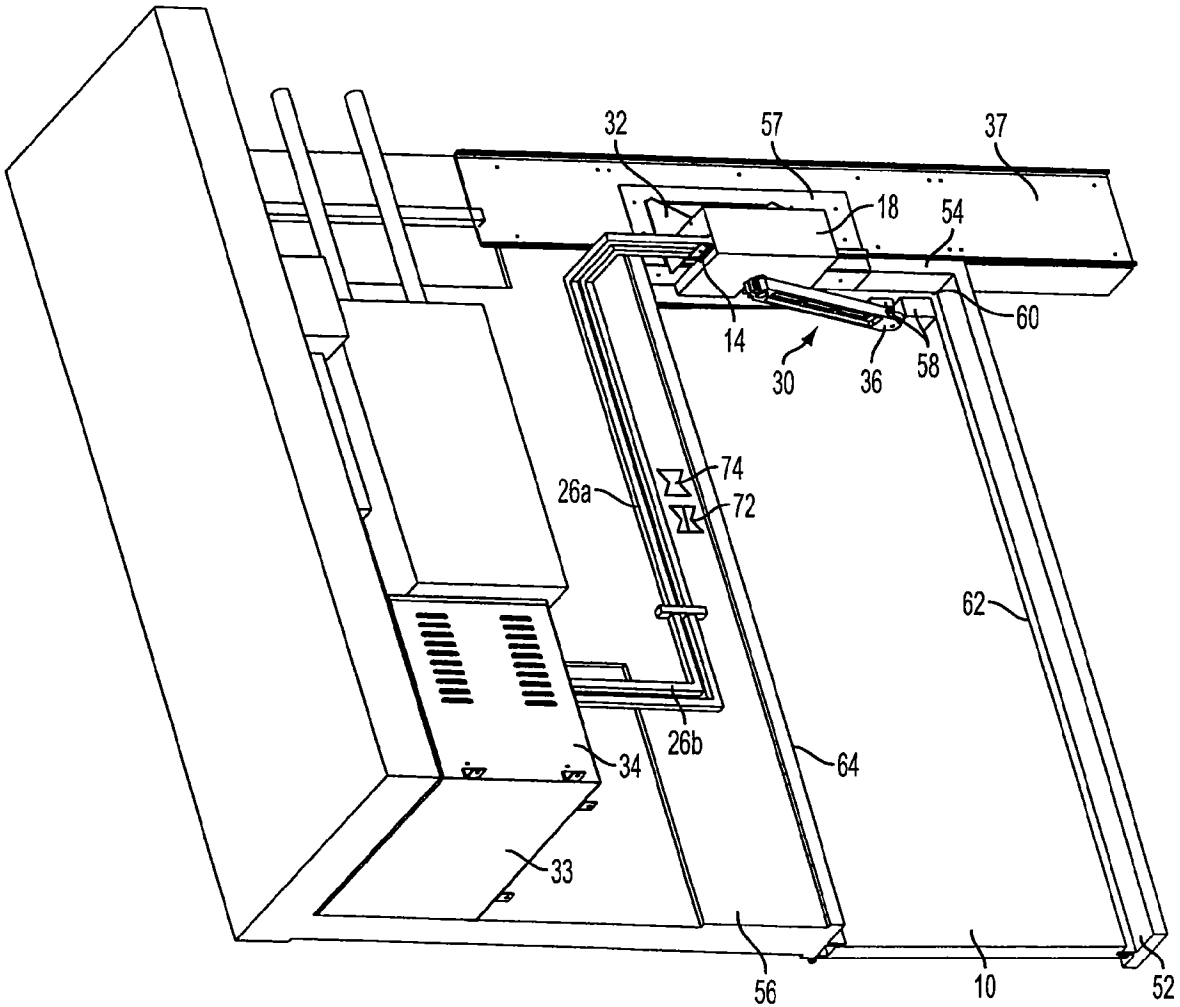
FIG. 2 is a perspective bottom view, partially broken away, of the mechanical arm system disposed in the exemplary environment of FIG. 1.
Figure 9:
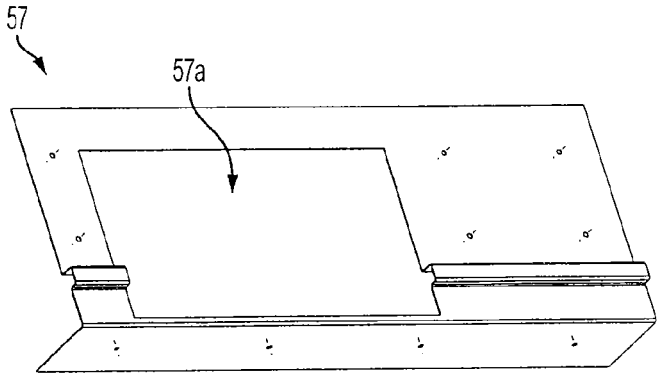
FIG. 9 is a perspective front side view of a door frame brace.
Figure 10:
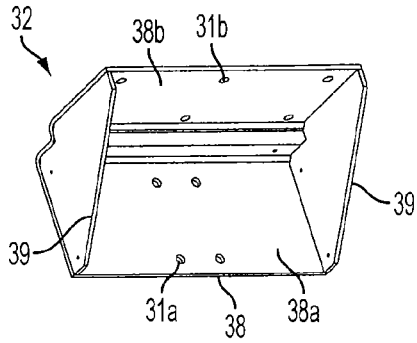
FIG. 10 is a perspective top view of an actuator bracket assembly for mounting the actuator adjacent a door.
Figure 11:
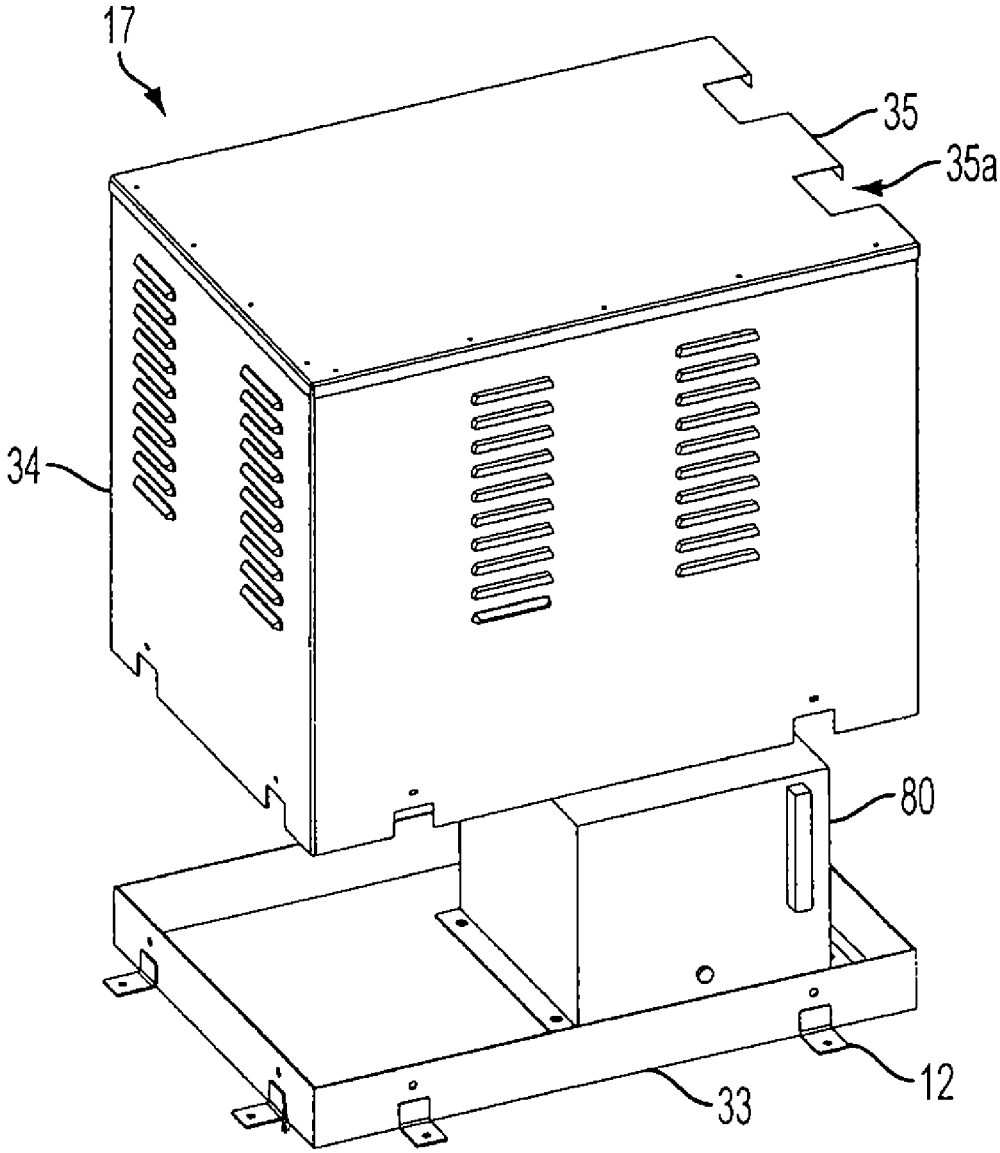
FIG. 11 is an exploded perspective view of a housing for a pump of the mechanical arm system, in accordance with an embodiment presented herein.

FIGS. 1-12 illustrate a mechanical arm system, and/or components thereof, for automatic opening of a door, in accordance with an embodiment presented herein. As shown in FIGS. 1 and 2, the mechanical arm system of this embodiment is located in an environment interior of a door 10, which is a left-hinged door that opens outward in a direction of arrow O. The mechanical arm system includes an actuator 40 (shown in FIGS. 3 and 4), an arm 30 having an elongated pivot member 36 and a tread wheel 21, a pump 80 (housed in a housing 17, as shown in FIG. 11) for supplying hydraulic fluid to actuator 40, and a controller unit 78 (schematically shown in FIG. 12) which may be housed in a control box 25. An open switch 74 is provided adjacent a door jamb of door 10, on both the interior side and exterior side (not shown) of door 10. When open switch 74 is activated by a user, switch 74 signals controller unit 78 to operate arm 30 so as to force door 10 open. The mechanical arm system may further include an emergency stop switch 72 also provided adjacent a door jamb of door 10, on both the interior side and exterior side (not shown) of door 10. When emergency stop switch 72 is activated by a user, if door 10 is in the process of being opened or is then fully opened by arm 30, arm 30 is immediately retracted away from contact with door 10 to permit door 10 to return to the illustrated closed position. A pair of conduits 26*a* and 26*b* fluidly connect pump 80 with actuator 40. Conduits 26*a* and 26*b* are secured along a wall 56 by one or more routing mounts 24, and their end portions that are joined to actuator 40 are further supported by a bracket 14 secured to an actuator shroud 18 that surrounds actuator 40. Conduits 26*a* and 26*b* may be pipes or hoses of suitable internal diameter to achieve the hydraulic pressure needed for actuator 40 to operate so as to force door 10 open, as would be apparent to one of skill in the art. When pump 80 is operated in one direction of fluid displacement, actuator 40 drives arm 30 against door 10, forcing door 10 toward an open position. In this instance, conduit 26*a* may operate as a supply line to supply pressurized hydraulic fluid from pump 80 to actuator 40, and conduit 26*b* operates as a return line to return hydraulic fluid to pump 80. When pump 80 is operated to reverse the direction of fluid displacement, conduit 26*b* then operates as the supply line to actuator 40, and actuator 40 is then operated to drive arm 30 away from contact with door 10 so as to permit door 10 to return to the closed position. More detail with regard to the operational process of the mechanical arm system is described below with reference to FIG. 13.

As noted above, door 10 is a left-hinged door, hinged at 51 along a left side 64 of door 10 when viewed from the door's interior. Door 10 opens at its right side 62 so as to open outward in the direction of arrow O. In this embodiment, door 10 is a sound control door equipped with a balanced magnetic contact switch 58 for detecting opening of the door. Switch 58 has components mounted on a lintel 54 of a door frame 52 and on the upper right corner 60 of door 10. Further, door 10 may have magnetic seals (not shown) around door 10, such as at the door jambs and door head, to ensure door 10 is secured in the illustrated closed position unless and until the seals are broken by enough force to overcome the magnetic force. In one embodiment, door 10 is constructed as a SCIF door, such that the environment interior of the door is a controlled space of a SCIF. In this instance, a key card entry device may be linked to open switch 74 so that a key card is required to activate open switch 74.

Figure 3:
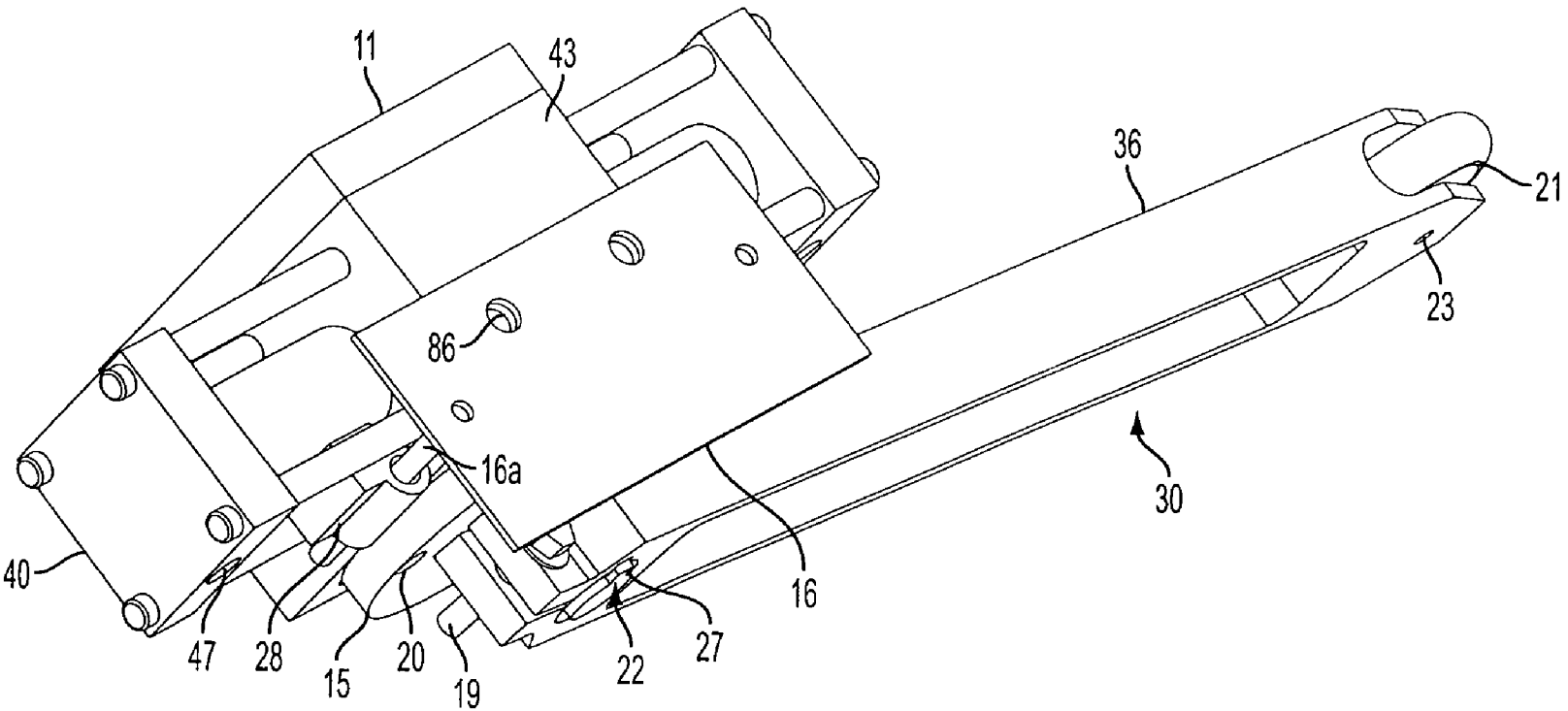
FIG. 3 is a perspective front side view of an actuator and an arm of a mechanical arm system, according to an embodiment presented herein.
Figure 4:
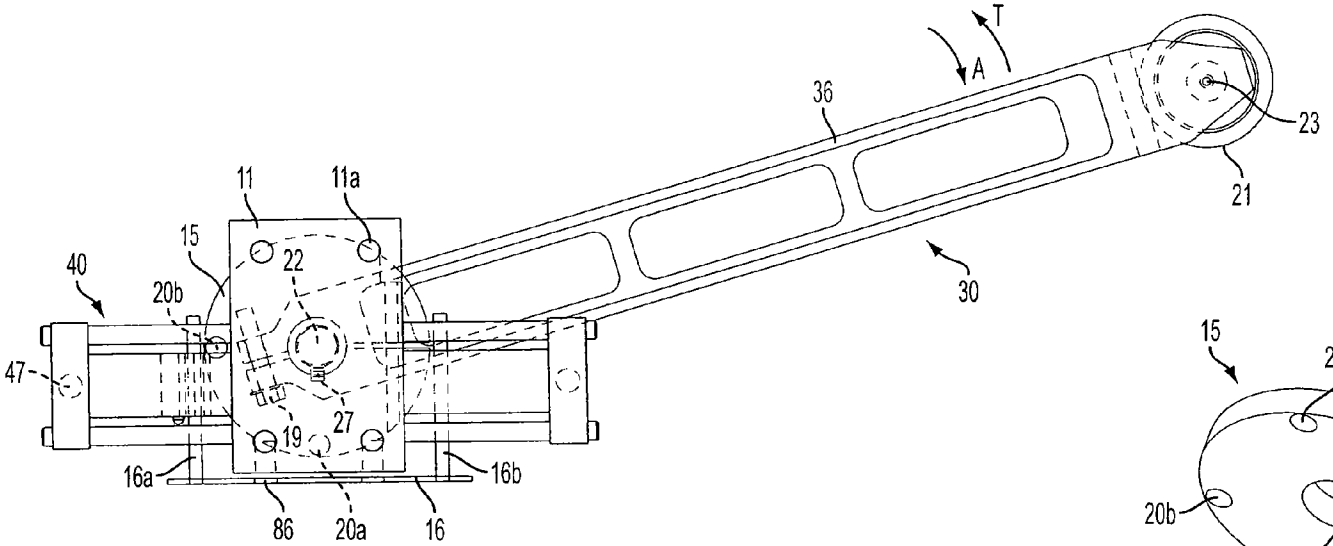
FIG. 4 is a top view of the actuator and the arm of FIG. 3.

An actuator assembly 70 is secured to a surface adjacent door 10. In one embodiment, actuator assembly includes actuator 40, along with an actuator shim 11 and an actuator bracket 32, which hold actuator 40 in place adjacent door 10. As shown in FIGS. 3 and 4, actuator shim 11 is joined to a top surface of a housing 43 of actuator 40. FIG. 10 shows a perspective view of actuator bracket 32. Actuator bracket 32 includes bracket 38 having horizontally extending portion 38*a* and vertically extending portion 38*b*. Left and right gussets 39 welded between portions 38*a* and 38*b* on the left and right sides of bracket 38, respectively, reinforce bracket 38. Actuator shim 11 includes four threaded mounting holes 11*a* for mounting actuator 40 to actuator bracket 32. These mounting holes 11*a* correspond with four mounting holes 31*a* of horizontally extending portion 38*a* of bracket 38, and the mounting holes on the bracket 38 and shim 11 receive rivets, screws, or the like so as to secure actuator 40 to bracket 32. In the embodiment shown in FIG. 1, actuator assembly 70 is mounted to a support member above door 10. The support member may include either door lintel 54 itself and/or the portion of wall 56 above door lintel 54. In this embodiment, actuator bracket 32 is secured to a wall mounting plate 37 mounted on wall 56 above lintel 54 of door frame 52. Lintel 54 is reinforced by a door frame brace 57, which is also secured to wall mounting plate 37. As shown in FIG. 9, providing a perspective view of door frame brace 57, an opening 57*a* is formed in door frame brace 57. Vertically extending portion 38*b* of bracket 38 is positioned at opening 57*a* so that vertically extending portion 38*b* may then directly abut wall mounting plate 37 and be secured thereto by rivets, screws, or the like received in holes 31*b* of vertically extending portion 38*b*.

Figure 6:
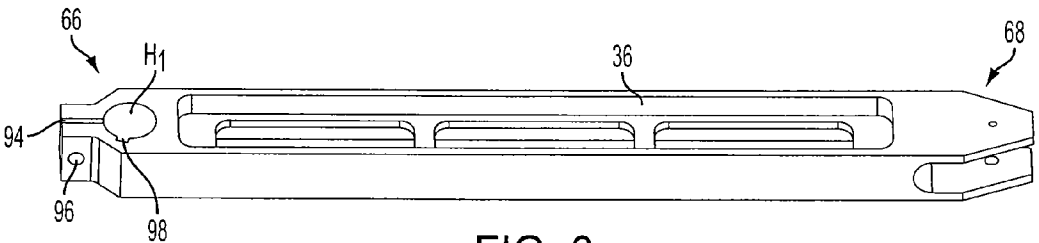
FIG. 6 is a perspective side view of a pivot member of the arm of the mechanical arm system of FIG. 3.
Figure 14:
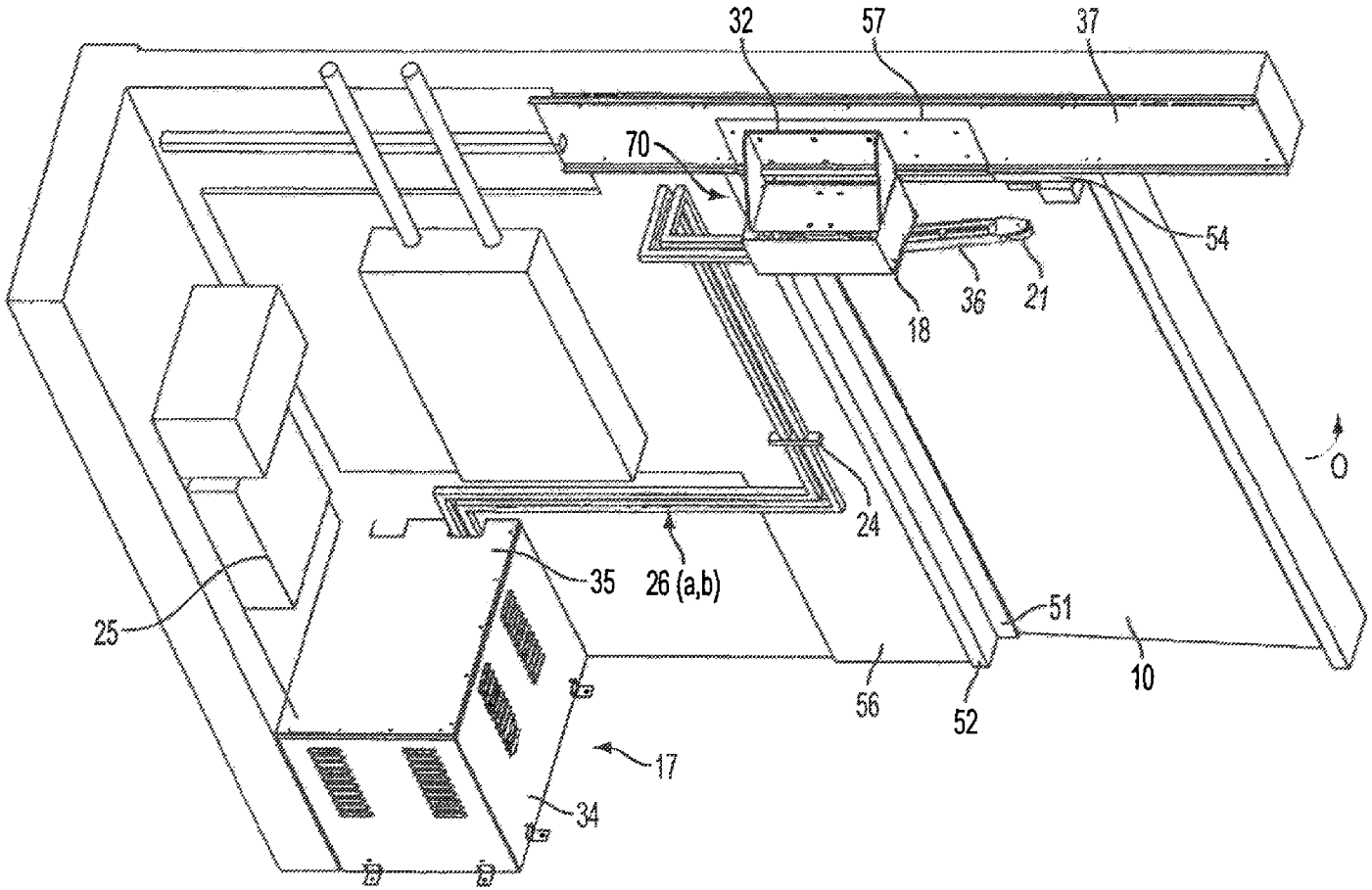
FIG. 14 is a perspective top view, partially broken away, of the mechanical arm system of FIG. 1, in which the arm does not contact the door with the door in its closed position, according to an embodiment presented herein.

FIGS. 3 and 4 show a side perspective view and a top view, respectively, of actuator 40 and arm 30 of the mechanical arm system. Actuator includes an output shaft 22 for driving arm 30 to force door 10 toward an open position (not shown), to allow entry into the environment (e.g., SCIF) interior of door 10. As shown in FIG. 6, elongated pivot member 36 of arm 30 has a proximal end portion 66 having a hole $H_1$ for receiving shaft 22 and a distal end portion 68 that supports tread wheel 21. As shown in FIGS. 3 and 4, tread wheel 21 is rotatably mounted on distal end portion 68 by a shoulder screw 23 or the like. Wheel 21 may be made of any durable material, such as polyurethane, that includes a non-slip surface and is able to withstand transfer of force from arm 30 to door 10 during the door opening process. Output shaft is keyed with a keyway 27 that engages with a indention 98 of hole $H_1$ so that pivot member 36 is effectively spline-fitted on output shaft 22 and rotates with rotation of output shaft 22. Proximal end portion 66 of pivot member 36 having an elongated gap 94, extending from the end to hole $H_1$, is pinched together by a bolt 19 so as to compress the peripheral surface of hole $H_1$ firmly about shaft 22, further securing pivot member 36 to output shaft 22. As shown in FIG. 4, arm 30 pivots in a first direction T (indicated by arrow T) and in a second, opposite direction A (indicated by arrow A). As will be further described below, in the first direction T, arm 30 is moved against door 10 to force door 10 toward the open position and thereafter holds the door in the open position to allow entry and exit of persons or items through door 10. In the embodiment shown in FIG. 1, actuator 40 is positioned above door 30 so that arm 30 is able to make initial contact with the door near upper right corner 60 of door 10, about 3 inches below its top edge. As arm 30 forces door 10 toward its open position, wheel 21 rolls horizontally along the door's surface in a direction toward the door's left side 64. In the second direction A, arm 30 is moved away from contact with door 10, whereby door 10 is free to swing back to its closed position, under its own power, and with any additional assistance from a conventional door closer (not shown), if provided. In one embodiment, (shown in FIG. 14), arm 10 does not contact door 10 when it is in its initial "home" position prior to being pivoted to open door 10. Arm may hover about an inch or two above the surface of door 10 unless and until arm 30 is pivoted to force door 10 open. In another embodiment, arm 10 may slightly touch the surface of door 10 when arm 30 is in its home position; however, arm 10 is not mounted on, or make permanent contact with door 10. If door 10 is open, door 10 may return to its closed position free from contact with arm 10 when arm 10 is retracted to its home position to permit door 10 to close.

Figure 5:
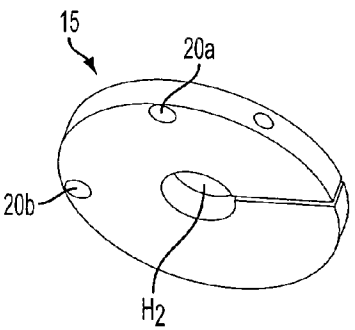
FIG. 5 is a perspective view of a ring magnet holder of a relay sensor that senses rotational position of an output shaft of the actuator of FIG. 3.
Figure 8:
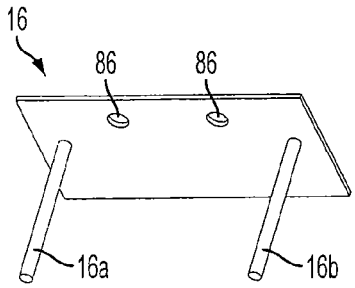
FIG. 8 is a perspective side view of a holder for a magnetically actuated switch of the relay sensor.

The mechanical arm system may further include a relay sensor 79 (schematically illustrated in FIG. 12) for sensing the rotational position of output shaft 22. Relay sensor 79 includes a magnetically actuated switch 28, such as a reed switch, which is supported by an arm 16*a* of a holder 16 disposed on a side of actuator 40. As shown in FIG. 8, holder 16 includes mounting holes 86 for mounting holder 16 to actuator 40. Holder 16 has a second arm 16*b* laterally opposed to first arm 16*a*, which is used to support reed switch 28 when the mechanical arm system is configured to open a right hinged door. Reed switch 28 is tripped by magnets 20*a*, 20*b* supported by a ring magnet holder 15 that rotates with rotation of output shaft 22. As shown in FIG. 5, ring magnet holder 15 has a hole $H_2$ for receiving an end of shaft 22 there through. Magnets 20*a* and 20*b* are positioned near a peripheral edge of ring holder 15 so as to be 90 degrees apart from each other. When output shaft 22 rotates arm 30 to open door 10, magnet 20*a* rotates away from reed switch 28, tripping switch 28 by removal of the magnetic field caused by magnet 20*a*, and when shaft has rotated 90 degrees, magnet 20*b* rotates toward reed switch 28, tripping switch 28 by application of the magnetic field of magnet 20*b*. As a result, relay sensor 79 detects when output shaft has rotated 90 degrees (and when door 10 has likewise opened 90 degrees under force of arm 30). As described in further detail below, relay sensor 79 sends a signal to controller unit 78, which turns off pump 80. Door 10 is then held in the open position by arm 30 until arm 30 is retracted away from door 10.

Figure 7:
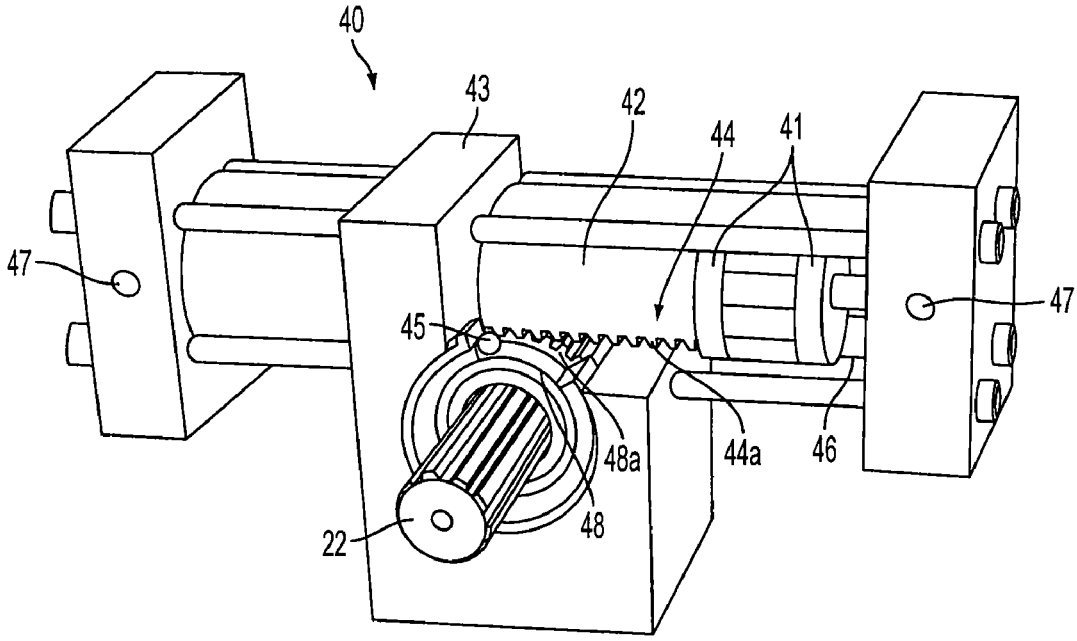
FIG. 7 is a perspective bottom view, partially broken away, of an exemplary hydraulic rack and pinion rotary actuator.

In one embodiment, actuator 40 is a conventional hydraulic rack and pinion rotary actuator, shown in FIG. 7. In this embodiment, actuator 40 includes a piston 42 with a rack 44 integrally formed on its outer surface. Piston 42 is housed in a cylinder 46, and piston seals 41 provide a fluid and air seal between piston 42 and an inner surface of cylinder 46, in a known manner. Teeth 44*a* of rack 44 engage with teeth 48*a* of a pinion 48 that rotates output shaft 22. Pinion 48 is supported by bearings 45 and may be formed integrally with output shaft 22 or may be coaxially, non-relatively rotatably coupled to output shaft 22. One end of each conduit 26*a* and 26*b* communicate with respective ports 47 of actuator 40 for feeding pressurized fluid to actuator 40 from pump 80.

Housing 17 for pump 80 is illustrated in FIG. 11. Housing 17 is formed of a vented shroud 34 having top and bottom openings closed by cover 35 and pan 33, respectively. Cover 35 has cutouts 35*a* which provide openings in housing 17 through which conduits 26*a* and 26*b* extend, as shown in FIG. 2. Though not shown, a power unit for operating pump 80 and a fluid reservoir may also be housed in housing 17, and pump 80, reservoir, and power unit may be available as a prepackaged pump unit, such as the pump units available from Parker Automation. Housing 17 may be secured to a floor area near door 10 by floor tabs 12. The capacity of pump 80 may be chosen as needed to deliver the needed pressure for providing output shaft 22 with enough torque so that arm 30 forces door 10 open. For example, assuming door 10 is a 1000 lb door, 85 inches tall and about 45 inches wide, and having magnetic seals, a 0.5 HP pump, with a pressure maximum of 1000 psi, should suffice to operate actuator 40 within the pump's midrange capacity for opening door 10. In this example, it is estimated that approximately 45 lbs of force is needed to push open door 10 from its interior side. This demands pump 80 to provide approximately 300 to 350 psi actuation pressure for rotating arm 30 against door 10, to break the magnetic seals and force door 10 to the open position in about 6 seconds. Controller unit 78 controls pump 80, and controller unit 78 may be configured to control pump 80 at a given operating hydraulic pressure determined to be optimal for achieving the desired opening speed of a door with a given set of specifications.

Figure 12:
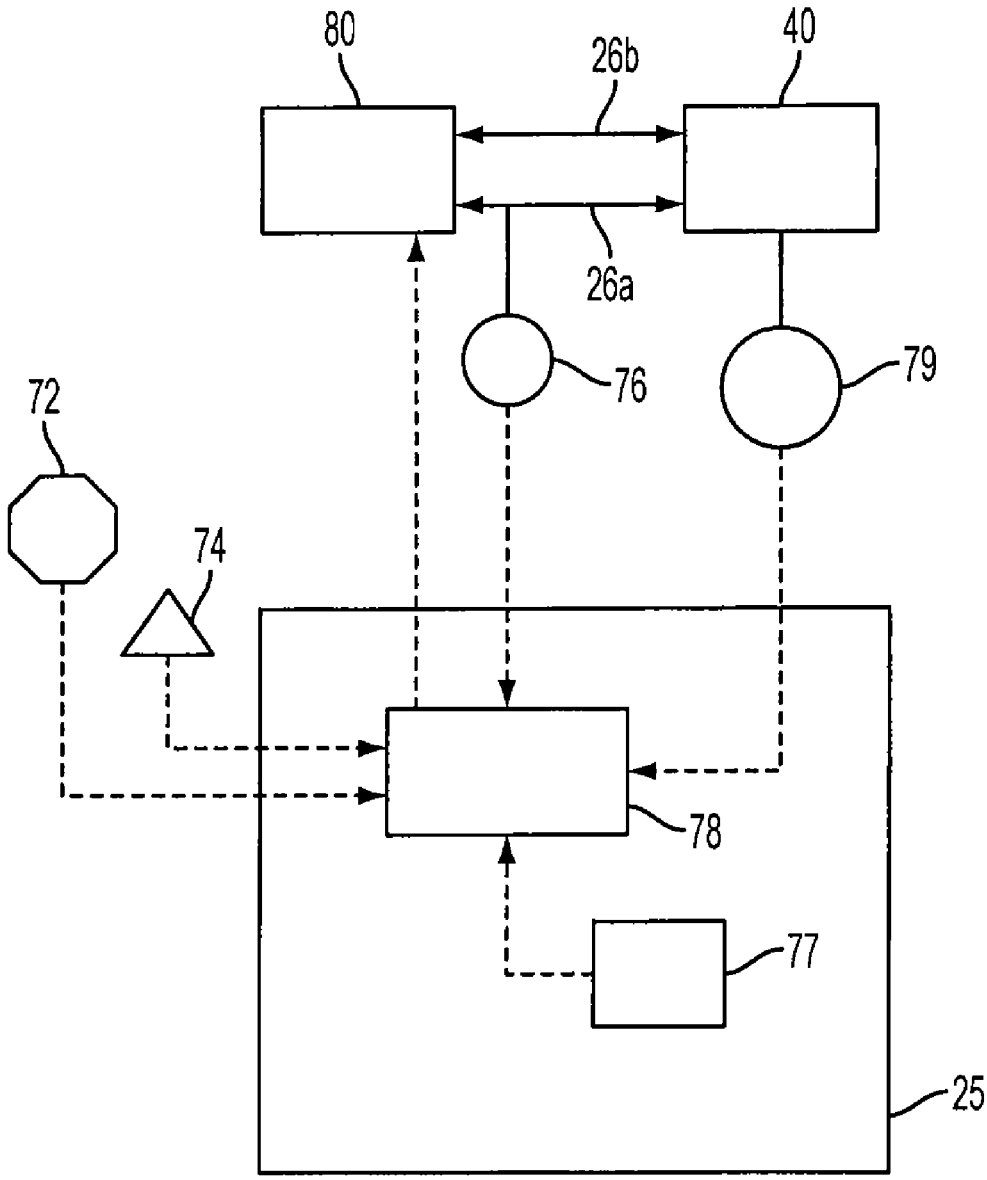
FIG. 12 is a schematic of a controller unit of the mechanical arm system in communication with other components of the mechanical arm system.

FIG. 12 illustrates a schematic of controller unit 78 in electronic communication with other components of the mechanical arm system, in accordance with one embodiment presented herein. As described in further detail below, controller unit 78 in control box 25 is in electronic communication with a timer 77, open switch 74, emergency stop switch 72, pump 80, relay sensor 79, and a pressure overload sensor 76. Timer 77 determines the amount of time door 10 is held in the open position by arm 30. When a predetermined amount of time has passed, controller unit 78 turns on pump 80 with a direction of fluid displacement that causes output shaft 22 to pivot arm 30 away from door 10, allowing the door to close.

The predetermined amount of time should be a time that allows for entry or exit of persons or items through door 10 prior to door 10 closing. For example, after door 10 has reached its fully open position of 90 degrees, a delay of between 6 to 10 seconds before door 10 closes may be sufficient to allow for entry and exit through door 10. Accordingly, controller unit 78 communicates with timer 77 to identify when the set time has passed. The mechanical arm system may be equipped to include a pressure overload sensor which senses the hydraulic pressure in conduit 26*a* supplying fluid to actuator 40. If the hydraulic pressure exceeds a pre-set limit, controller unit 78 may be configured to turn off pump 80, or alternatively, to reverse the flow direction of hydraulic fluid displaced by pump 80 so as to retract arm 30. The pre-set limit should be a pressure that may be associated with an abnormality in the system. Primarily, pressure overload sensor 78 serves as a proxy for identifying when an obstruction may exist in the pathway of opening door 10 that prevents door 10 from obtaining its open position. For the force needed to rotate the door described above, an exemplary pre-set pressure limit is 450 psi.

Figure 13:
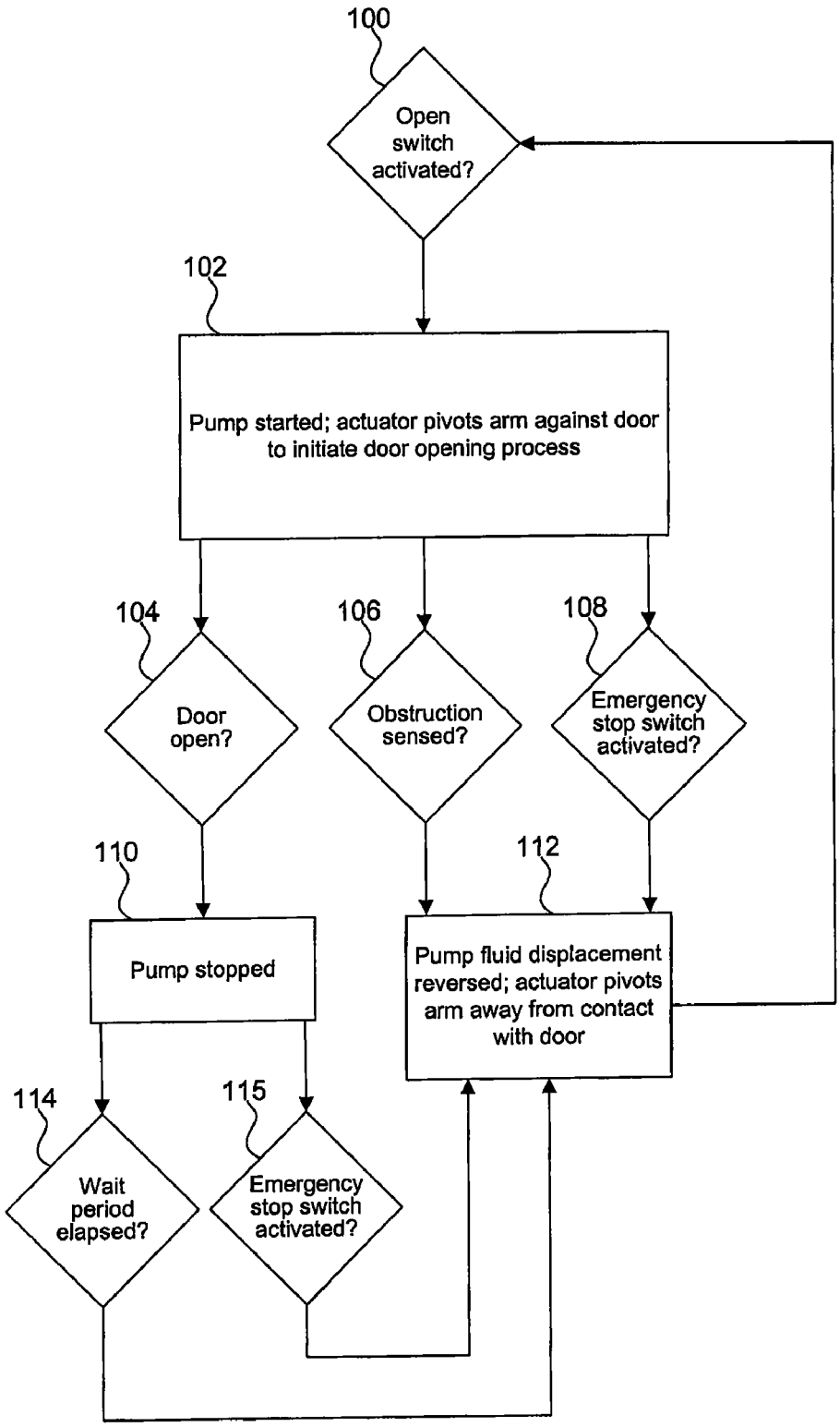
FIG. 13 is a flowchart illustrating an exemplary process of operation and control logic of the mechanical arm system, in accordance with an embodiment presented herein.

An exemplary process of operation and control logic of the mechanical arm system will now be described with reference to the flowchart shown in FIG. 13. With door 10 in the closed position illustrated in FIG. 1, operation of the mechanical arm system starts at step 100, whereby a user activates open switch 74 on either the interior side or the exterior side of door 10. Upon receiving a signal from open switch 74, controller unit 78 starts pump 80 at step 102, and pressurized fluid is sent through supply conduit 26*a* to actuator 40. Output shaft 22 is thereby rotated and pivots arm 30 in direction T (shown in FIG. 4) against door 10 and initiate the door opening process. While door 10 is being opened under force of arm 30, if an obstruction is sensed at step 106 (based on a signal to controller unit 78 from pressure overload sensor 76, described above), the opening process is aborted. At step 112, controller unit 78 controls pump 80 to reverse the direction of fluid displacement. The rotational direction of output shaft 22 is thereby reversed, and arm 30 is pivoted away from contact with door 10 in direction A (shown in FIG. 4). Arm 30 returns to its initial "home" position fairly quickly (e.g., one to two seconds), so that door is free to return to its closed position and corrective action may be taken to remove the obstruction in the door's pathway. The opening process may also be aborted at step 108, whereby a user activates emergency stop switch 72 (either on the interior side or the exterior side of door 10) so that at step 112 controller unit 78 controls pump 80 and likewise actuator 40 so as to retract arm 30, as described above. As noted above, in an alternative embodiment, pump 80 may be stopped instead and arm 30 held stationary if an obstruction is sensed or the emergency stop switch is activated.

If neither an obstruction is sensed nor the emergency stop switch is activated, door 10 should complete its opening process and reach its open position at step 104, which is detected by relay sensor 79. At step 110, controller unit 80 stops pump 80, and arm 30 remains in contact with door 10 so as to hold door 10 in the open position. Timer 77 starts when door 10 reaches the open position. When a predetermined amount of time, or wait period, has elapsed as determined at step 114 (or if the emergency stop switch is activated at step 115 before this wait period has elapsed), pump 80 is turned on at step 112, with its fluid displacement reversed so that actuator 40 moves arm 30 free from contact with door 10 to its home position. With arm 30 in its home position, the mechanical arm system waits for another open door signal at step 100. Door 10 may then swing to its closed position on its hinges under its own power, and with any assistance from a door closer, if provided.

The mechanical arm system provides an automatic door opening mechanism for a door which is particularly suitable for an SCIF door, as it may be configured to meet the specifications for such a door. No components of the mechanical arm system are mounted on door 10, and arm 30 may be configured to not touch door when it is in its home position. Further, door 10 does not need to reach its fully open position before closure can be initiated. Rather, the opening process may be aborted at anytime before door 10 reaches its open position. Further, the mechanical arm system may be operated to allow door 10 to prematurely closed after door 10 reaches its open position, such as when emergency stop switch 72 is activated at step 115, as described above with reference to FIG. 13. Moreover, the mechanical arm system is operable with a manually moveable door. Since arm 30 does not make permanent contact with door 10, when door 10 is manually opened (and open switch 74 is not activated), arm 30 does not move with door 10.

While various embodiments of the present invention have been described above, it should be understood that they have been presented by way of example only, and not limitation. It will be apparent to persons skilled in the relevant art that various changes in form and detail can be made therein without departing from the spirit and scope of the invention. For example, the mechanical arm system may be configured to operate with a plurality of door configurations, such as left or right hinged doors and outward or inward swinging doors, and the actuator may be mounted at a plurality of locations near the door. Thus, the breadth and scope of the present invention should not be limited by any of the above-described exemplary embodiments, but should be defined only in accordance with the following claims and their equivalents.

What is claimed is:

1. A mechanical arm system in combination with a Sensitive Compartmented Information Facility (SCIF) door, the mechanical arm system for opening the SCIF door from a closed position to an open position, comprising:

an actuator assembly having an output shaft, said actuator assembly being mounted to a support member adjacent the door; and an arm driven by the output shaft so as to selectively contact the door to move the door toward the open position, wherein the arm is moveable between a position in which the arm directly or indirectly contacts the door in the open position and a retracted position in which the arm is free from direct or indirect contact with the door in the closed position.

2. The mechanical arm system of claim 1, wherein the support member adjacent the door includes a wall above the door.

3. The mechanical arm system of claim 1, wherein the door is manually moveable between the closed and the open positions.

4. The mechanical arm system of claim 1, wherein the arm pivots in a first direction for contacting the door and a second direction for retracting from contact with the door, the arm pivoting with rotation of the output shaft.

5. The mechanical arm system of claim 4, wherein the actuator assembly includes a hydraulic rack and pinion rotary actuator having a piston that drives a rack which meshes with a pinion.

6. The mechanical arm system of claim 5, wherein the output shaft is coaxial with the pinion and rotates with rotation of the pinion.

7. The mechanical arm system of claim 5, further comprising a controller unit that activates and deactivates the hydraulic actuator and controls a rotational direction of the output shaft so as to pivot the arm in the first direction or the second direction.

8. The mechanical arm system of claim 7, further comprising a hydraulic pump for supplying fluid to the hydraulic actuator, wherein the controller unit is in electronic communication with the hydraulic pump and controls start and stop of the hydraulic pump so as activate and deactivate the hydraulic actuator, and controls the direction of fluid displacement by the pump so as to control the rotational direction of the output shaft, wherein the direction of fluid displacement by the pump causes the output shaft to pivot the arm in the second direction to the retracted position.

9. The mechanical arm system of claim 8, further comprising a relay sensor in electronic communication with the controller unit, wherein the relay sensor senses when the door has reached the open position under force of the arm, wherein when the open position has been sensed, the controller unit deactivates the hydraulic actuator, the arm remaining in contact with the door and holding the door in the open position until the arm has been moved to the retracted position.

10. The mechanical arm system of claim 9, further comprising a timer in electronic communication with the controller unit, wherein the timer determines the amount of time the door is held in the open position by the arm, wherein when a predetermined amount of time has passed, the controller unit activates the actuator and controls the rotational direction of the output shaft so as to move the arm to the retracted position.

11. The mechanical arm system of claim 8, further comprising a pressure overload sensor in electronic communication with the controller unit, wherein the pressure overload sensor senses when the hydraulic pressure of fluid supplied to the hydraulic actuator rises above a pre-set limit, wherein, when the pre-set pressure limit has been exceeded, the controller unit controls the rotational direction of the output shaft so as to so as to move the arm to the retracted position.

12. The mechanical arm system of claim 8, further comprising a stop switch manually operable by a user and in electronic communication with the controller unit, for aborting movement of the door toward the open position under force of the arm, wherein, when the stop switch has been activated, the controller unit controls the rotational direction of the output shaft so as to pivot the arm in the second direction to the retracted position, whereby the door is permitted to return to the closed position.

13. The mechanical arm system of claim 8, further comprising an open switch in electronic communication with the controller unit, for initiating movement of the door toward the open position under force of the arm, wherein, when the open switch has been activated, the controller unit controls the rotational direction of the output shaft so as to pivot the arm in the first direction, whereby the arm contacts the door and moves the door toward the open position.

14. A mechanical arm system in combination with a Sensitive Compartmented Information Facility (SCIF) door, the mechanical arm system for opening the SCIF door, comprising:

an actuator assembly having an output shaft, said actuator assembly being mounted to a support member adjacent the door; and an arm driven by the output shaft, said arm extending between the output shaft and the door, wherein the arm moves the door from a closed position toward an open position, and wherein the arm is free from direct or indirect contact with the door when the door moves from the open position to the closed position, and wherein the arm is free from direct or indirect contact with the SCIF door in the closed position, wherein the door is configured to swing back to the closed position under its own power.

15. The mechanical arm system of claim 14, further comprising a controller unit for controlling the actuator assembly so as to alternatively rotate the output shaft in a first direction and a second direction opposite the first direction, wherein, when the controller unit activates the actuator assembly to initiate a door opening process, the output shaft is rotated in a first direction to move the arm against the door so as to force the door toward the open position.

16. The mechanical arm system in combination with a Sensitive Compartmented Information Facility (SCIF) door, the mechanical arm system for opening the SCIF door, comprising:

an actuator assembly having an output shaft, said actuator assembly being mounted to a support member adjacent the door;

an arm driven by the output shaft, said arm extending between the output shaft and the door, wherein the arm moves the door from a closed position toward an open position, and wherein the arm is free from direct or indirect contact with the door when the door moves from the open position to the closed position, and wherein the arm is free from direct or indirect contact with the SCIF door in the closed position;

a controller unit for controlling the actuator assembly so as to alternatively rotate the output shaft in a first direction and a second direction opposite the first direction, wherein, when the controller unit activates the actuator assembly to initiate a door opening process, the output shaft is rotated in a first direction to move the arm against the door so as to force the door toward the open position; and a stop switch manually operable by a user and in electronic communication with the controller unit, wherein the opening process is aborted when the stop switch is activated, wherein the controller unit activates the actuator assembly so that the output shaft rotates in the second direction and moves the arm away from direct or indirect contact with the door, whereby the door is permitted to close under its own power.

* * * * *

UNITED STATES PATENT AND TRADEMARK OFFICE

CERTIFICATE OF CORRECTION

PATENT NO. : 8,074,401 B2
APPLICATION NO. : 11/770686
DATED : December 13, 2011
INVENTOR(S) : Booker T. Brown It is certified that error appears in the above-identified patent and that said Letters Patent is hereby corrected as shown below:

In claim 8, column 9, line 10, reading “so as activate” should read --so as to activate--.

In claim 8, column 9, line 39, reading “so as to so as to move” should read --so as to move--.

In claim 16, column 10, line 25, reading “The mechanical arm” should read --A mechanical arm--.

Signed and Sealed this
Seventh Day of February, 2012

David J. Kappos

David J. Kappos
*Director of the United States Patent and Trademark Office*